US006366642B1

(12) United States Patent
Andrews

(10) Patent No.: US 6,366,642 B1
(45) Date of Patent: Apr. 2, 2002

(54) X-RAY TUBE COOLING SYSTEM

(75) Inventor: Gregory C. Andrews, Sandy, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 09/761,488

(22) Filed: Jan. 16, 2001

(51) Int. Cl.[7] ..... H01J 35/10
(52) U.S. Cl. ..... 378/130; 378/117; 378/141
(58) Field of Search ..... 378/114, 117, 378/119, 121, 123, 127, 130, 131, 140, 141; 165/285; 137/7, 12, 340; 417/19, 38

(56) References Cited

U.S. PATENT DOCUMENTS

| | | | | | |
|---|---|---|---|---|---|
| 4,768,212 | A | * | 8/1988 | Appelt et al. | 378/141 |
| 5,052,034 | A | * | 9/1991 | Schuster | 378/121 |
| 5,244,351 | A | * | 9/1993 | Arnette | 417/38 |
| 6,074,092 | A | | 6/2000 | Andrews | 378/200 |
| 6,115,454 | A | | 9/2000 | Andrews et al. | 378/140 |
| 6,249,569 | B1 | * | 6/2001 | Price et al. | 378/130 |

* cited by examiner

*Primary Examiner*—David P. Porta
*Assistant Examiner*—Therese Barber
(74) *Attorney, Agent, or Firm*—Workman, Nydegger & Seeley

(57) ABSTRACT

A cooling system for use in conjunction with rotating anode and stationary anode x-ray tubes. The cooling system includes a reservoir containing a volume of coolant in which a portion of the x-ray tube is immersed. A bladder incorporated in the reservoir and in communication with the atmosphere automatically permits thermal expansion of the coolant while maintaining the coolant at atmospheric pressure. An external cooling unit directs a flow of coolant through a pressure drop device proximate to the x-ray tube so that the flowing coolant removes heat from the x-ray tube. Upon exiting the pressure drop device, the heated coolant is directed to the reservoir and ultimately returned to the external cooling unit where heat is removed from the coolant and the coolant then redirected back to the pressure drop device to repeat the cycle. The cooling system includes a pressure switch connected to a pressure tap located upstream of the pressure drop device so that the pressure switch is positioned to sense the pressure of the coolant upstream of the pressure drop device. Simultaneously, the pressure switch is in communication with the coolant disposed in the reservoir. The relatively constant pressure of the coolant in the reservoir permits the pressure switch to consistently and reliably sense and indicate the differential in pressure between the coolant in the reservoir and the coolant upstream of the pressure drop device. The pressure differential sensed by the pressure switch is used to verify the coolant flow rate corresponding to the sensed differential. The sensed pressure differential is used to indicate on a controller/status panel whether or not the coolant flow rate is adequate, and is also used in conjunction with the controller/status panel to shut down the x-ray device if the coolant flow rate is inadequate to ensure safe and reliable operation of the x-ray device.

19 Claims, 4 Drawing Sheets

X-RAY TUBE COOLING SYSTEM

BACKGROUND OF THE INVENTION

1. The Field of the Invention

The present invention relates generally to x-ray devices. More particularly, embodiments of the present invention relate to an x-ray tube cooling system which includes features that serve to permit monitoring various coolant flow parameters, and thereby facilitate safe and reliable operation of the x-ray device.

2. The Relevant Technology

X-ray producing devices are extremely valuable tools that are used in a wide variety of applications, both industrial and medical. For example, such equipment is commonly used in areas such as diagnostic and therapeutic radiology; semiconductor manufacture and fabrication; and materials analysis and testing. While used in a number of different applications, the basic operation of x-ray tubes is similar. In general, x-rays, or x-ray radiation, are produced when free electrons are generated, accelerated, and then impinged upon a material of a particular composition.

Typically, this process is carried out within a vacuum enclosure. Disposed within the evacuated enclosure is an electron source, or cathode, and a target anode, which is spaced apart from the cathode. In operation, electrical power is applied to a filament portion of the cathode, which causes electrons to be emitted. A high voltage potential is then imposed between the anode and the cathode, thereby causing the emitted electrons to rapidly accelerate towards a target surface positioned on the anode. The anode may be a stationary type anode, as is often employed in the context of analytical x-ray tubes, or a rotating type as is commonly employed in the context of diagnostic x-ray devices used in medical applications. During operation of an x-ray tube, the electrons in the beam strike the target surface (or focal track) at a high velocity. The target surface on the target anode is composed of a material having a high atomic or "Z" number, and a portion of the kinetic energy of the striking electron stream is thus converted to electromagnetic waves of very high frequency, i.e., x-rays. The resulting x-rays emanate from the target surface, and are then collimated through a window formed in the x-ray tube for penetration into an object, such as a patient's body, or material sample. As is well known, the x-rays can be used for therapeutic treatment, for x-ray medical diagnostic examination, or material analysis procedures.

In addition to stimulating the production of x-rays, the kinetic energy of the striking electron stream also causes a significant amount of heat to be produced in the target anode. As a result, the target anode typically experiences extremely high operating temperatures. At least some of the heat generated in the target anode is absorbed by other structures and components of the x-ray device as well.

A percentage of the electrons that strike the target surface do not generate x-rays, and instead simply rebound from the surface and then impact another "non-target" surfaces within the x-ray tube evacuated enclosure. These are often referred to as "secondary" electrons. These secondary electrons retain a significant amount of kinetic energy after rebounding, and when they impact these other non-target surfaces, a significant amount of heat is generated. This heat can ultimately damage the x-ray tube, and shorten its operational life. In particular, the heat produced by secondary electrons, in conjunction with the high temperatures present at the target anode, often reaches levels high enough to damage portions of the x-ray tube structure. For example, the joints and connection points between x-ray tube structures can be weakened when repeatedly subjected to such thermal stresses. In some instances, the resulting high temperatures can even melt portions of the x-ray tube, such as lead shielding disposed on the evacuated enclosure. Such conditions can shorten the operating life of the tube, affect its operating efficiency, and/or render it inoperable.

In view of the significant dangers posed by excessive heat levels in x-ray tubes and devices, various types of cooling systems have been devised to aid in the removal of heat from x-ray devices. For example, many conventional x-ray tube systems utilize some type of liquid cooling arrangement wherein a flow of coolant is generated and directed into contact with various surfaces and components of the x-ray tube so as to remove some of the heat generated there. The heated coolant is typically returned to an external cooling unit which removes heat from the coolant and then returns the coolant to the x-ray device. As discussed below, the configuration of the cooling system may vary somewhat depending on the type of x-ray device with which it is employed.

In the case of stationary anode type x-ray tubes, for example, the liquid coolant is typically injected, by way of a coolant injection nozzle, into a passage defined by the anode. The coolant absorbs heat from the anode and then exits the passage before returning to the external cooling unit.

The configuration of the cooling system is somewhat different in the context of typical rotating anode type x-ray tubes. In particular, many rotating anode x-ray tubes contain structures through which, or over which, a flow of coolant is directed. The coolant absorbs heat as it contacts these structures, and then ultimately returns to the external cooling unit.

It is well known that the ability of a coolant to remove heat is at least partially a function of the flow rate of that coolant. In particular, where two coolant streams are substantially equivalent in all other regards, a coolant stream characterized by a relatively higher flow rate will generally remove heat at a relatively higher rate than a coolant stream having a relatively lower flow rate.

Generally, the coolant flow rate in an x-ray tube cooling system is a function of the amount of heat produced by the x-ray device. Because the failure to maintain an adequate coolant flow rate may result in damage to the x-ray device, x-ray cooling systems using a liquid coolant are typically designed to ensure that a certain minimum of coolant flow rate is maintained. Various types of instrumentation and control systems have been devised and employed in conjunction with liquid cooling systems in attempt to ensure maintenance and/or verification of a minimum acceptable coolant flow rate. As discussed in detail below however, known devices and systems suffer from a variety of shortcomings.

In one known type of cooling system, a direct flow measuring device such as a turbine meter, plunger, or rotameter is included "in-line" in the coolant circuit. That is, the coolant must pass through the direct flow measuring device in order for the device to be effective in measuring the coolant flow rate. Typically, such direct flow measuring devices include an electrical switch or the like arranged so that upon achievement of a desired coolant flow rate through the device, contacts on the electrical switch close and complete a circuit. Generally, the circuit includes some type of visual indicator or the like to show that at least the minimally acceptable coolant flow rate has been established.

While direct flow measuring devices are generally effective in indicating coolant flow rates, they nevertheless suffer from some significant shortcomings. One such shortcoming relates to the fluid system energy losses imposed by such devices.

As is well known, the energy of a fluid system is often referred to as the "system head" and includes the energy represented by the velocity and pressure of the fluid in the system. In general, it is desirable to minimize losses in the energy of the system, or "head loss," which would tend to compromise performance of the fluid system. As discussed below however, some head loss is unavoidable.

In particular, the system head is affected by a variety of factors. For example, friction between the fluid and the piping through which it passes tends to reduce the velocity of the fluid, and thus, the overall energy of the system. Further, by virtue of their geometry and other characteristics, the devices and components in the fluid system tend to resist flow of fluid therethrough. This resistance to fluid flow is often described in terms of the "pressure drop" (head loss) imposed by that device or component on the fluid. Thus, the devices and components of the system tend to reduce the overall system energy by imposing a head loss, or decrease in pressure, on the system fluid.

Because known direct flow measuring devices are generally characterized by relatively large pressure drops, they tend to undesirably reduce the overall energy of the fluid system and thereby compromise coolant flow and cooling system performance.

Another problem associated with many types of direct flow measuring devices relates to the mechanism by which such devices perform the flow sensing function. In particular, such mechanisms are relatively sensitive and accordingly must be kept free of contaminants and foreign matter so as to preclude any malfunction of the flow measuring device. Because of their sensitivity, such devices typically employ some type of filter which serves to screen out any contaminants and foreign matter that could impair the operation of the device. Although such filters are generally successful in this regard, their use implicates various undesirable consequences.

In particular, the addition of the filter in-line in the cooling system further increases the system head loss and thus compromises the overall performance of the cooling system, as discussed above. Furthermore, the filter represents a cost burden in that it must be incorporated into the x-ray tube, thereby increasing the price of the x-ray tube device.

Finally, as suggested earlier, the filter must be integrated into the cooling system in such a way that it can be readily installed. This functionality is typically achieved by way of pipe fittings, flanges or other removably attachable fluid connections. However, each of these fluid connections represents a point in the cooling system where a leak could occur. By necessitating the use of additional fluid connections in the system, these cooling system filters thus increase the likelihood of leaks and other system performance problems.

While direct flow measuring devices permit, as their name suggests, direct measurement of the rate of fluid flow through the device, various other sensors and cooling system configurations have been employed to sense other flow parameters, such as pressure, which can then be used as a basis for deriving the associated flow rate.

In one such configuration, a differential pressure ("DP") switch is connected across the coolant heat exchanger of the x-ray device and the DP switch is adjusted so that at a pre-determined minimum flow rate, the static pressure drop across the coolant heat exchanger is sufficient to complete a circuit in the DP switch, indicating that at least the minimum flow rate has been achieved. Because the flow rate is known, or can readily be determined, for a given pressure differential, the DP switch, indirectly, facilitates verification that the coolant flow rate is at least at the minimum acceptable level. In the event the pressure differential falls to a point which corresponds to a coolant flow rate lower than the minimal acceptable coolant flow rate, the circuit in the DP switch is opened, indicating an inadequate coolant flow rate.

While the DP switch avoids some of the problems inherent in in-line type flow sensing components such as turbine meter or plunger type direct flow measuring devices, the DP switch nevertheless presents some difficulties of its own. One such problem rates relates to the hookup configuration typically employed with DP switches.

In particular, the high pressure connection of the DP switch is typically connected upstream of the coolant heat exchanger, and the low pressure connection of the DP switch is connected downstream of the coolant heat exchanger. In this way, the DP switch is able to sense the pressure drop across the coolant heat exchanger. However, because the coolant pressure at both the inlet and outlet of the coolant heat exchanger typically varies during system operations, the measured pressure differential across the coolant heat exchanger will likewise fluctuate, and may accordingly cause inaccurate coolant flow indications.

Another difficulty associated with the use of DP switches to facilitate coolant flow rate indications relates to the relatively small pressure drop typically experienced in the context of the x-ray tube cooling system heat exchangers. In particular, the typical DP switch is not sufficiently sensitive to be activated by less than 0.5 pounds per square inch differential pressure ("PSID"). On the other hand, those DP switches which are sufficiently sensitive to respond to pressure differentials less than 0.5 PSID are, typically, relatively more expensive and physically larger than the more commonly used DP switches. Such an increase in cost is undesirable, and, the larger physical configuration precludes the use of such DP switches in many applications.

Another problem inherent in the use of DP switches concerns the number of fluid connections required to connect the DP switch to the cooling system. In particular, because the DP switch, by definition, must sense coolant pressure at two different points in the cooling system, a total of four fluid connections are required to establish fluid communication between the DP switch and the cooling system. In particular, the high pressure side of the DP switch must be connected to tubing which, in turn, is connected to the coolant system. The low pressure side of the DP switch must be connected in like fashion. As noted earlier, the introduction of such fluid connections in the cooling system increases the chances for system leaks and increases the overall maintenance burden associated with the cooling system.

At least one other configuration commonly employed to determine coolant flow rate in the x-ray tube cooling system involves the use of a pressure switch located at the cooling pump discharge line. Such pressure switches are distinct from DP switches in that the pressure switch is configured with a diaphragm or similar structure which is exposed on one side to atmospheric pressure, by way of a vent or the like in the switch body. The other side of the diaphragm in the pressure switch is exposed to system line pressure. These pressure switches thus measure the magnitude of the system line pressure in terms of pounds per square inch gage (PSIG). Because pressure switches are configured to measure pressure in terms of PSIG, they are relatively simple in construction and low in cost, as compared with DP switches which, as noted earlier, require two fluid connections to measure a pressure differential in PSID.

In operation, the coolant pump transfers energy to the coolant. If the cooling system is closed at some point such that the coolant is unable to flow, the energy thus transferred to the coolant is manifested primarily in the form of increased pressure in the coolant. If the cooling system is configured to permit flow of the coolant, the energy transferred to the coolant manifests itself in the form of pressure and velocity. Because the pressure switch is in fluid communication with the pump discharge line, the coolant leaving the pump acts on the diaphragm of the pressure switch and causes the pressure switch to generate a signal indicating that a particular pressure has been achieved in the pump discharge line. The pressure switch thus serves to verify that the cooling system pump in on line and transferring energy to the coolant.

While such configurations are effective in establishing the fact of increased coolant pressure, they are inadequate to provide meaningful feedback as to whether coolant is actually flowing. In particular, a situation could arise where a cooling system hose supplying the cooling system heat exchanger was kinked or obstructed in such a manner that no coolant flow was reaching the heat exchanger. However, the pressure switch located at the pump discharge would indicate that the coolant system was functioning because it would sense the pressure generated by the cooling pump. Thus, although no coolant would be reaching the heat exchanger in this example, the pressure switch would provide no indication whatsoever that there was a coolant system fault. Such a shortcoming is at best inconvenient and at worst may contribute to the failure of the x-ray device.

In view of the foregoing problems and shortcomings of existing x-ray tube cooling systems, it would be an advancement in the art to provide a cooling system configured to facilitate ready and reliable verification of coolant flow rates without compromising the overall operation of the cooling system or x-ray device. Further, the cooling system should be configured to facilitate implementation of corrective action in the event of a cooling system fault. Finally, the x-ray tube cooling system should be configured to minimize cost and reduce maintenance.

SUMMARY OF THE INVENTION

The present invention has been developed in response to the current state of the art, and in particular, in response to these and other problems and needs which have not been fully or adequately solved by currently available x-ray tube cooling system. Thus, it is an overall objective of embodiments of the present invention to provide an x-ray tube cooling system which includes provisions for facilitating the monitoring of coolant flow parameters so as to enhance the overall operation and reliability of the x-ray device.

A related objective is to provide an x-ray tube cooling system which uses one or more coolant flow parameters to at least indirectly control the operation of the x-ray device.

In summary, these and other objects, advantages, and features are achieved with an improved cooling system for use in effecting heat transfer from an x-ray tube and for at least indirectly controlling the operation thereof. Embodiments of the present invention are well suited for use in conjunction with rotating anode or stationary anode x-ray tube configurations.

In one embodiment of the present invention, the cooling system includes a reservoir holding a volume of coolant in which at least apportion of the x-ray device is partially immersed. Preferably, the reservoir includes a flexible bladder, or the like, which serves to accommodate increases in coolant volume due to heat absorption. Because of the flexible nature of the bladder and the fact that one side of the bladder is exposed to the atmosphere, the coolant in the reservoir remains at atmospheric pressure. An outlet connection of the reservoir is joined to a fluid conduit which is in fluid communication with an external cooling unit. Another fluid conduit facilitates fluid communication between the external cooling unit and a pressure drop device of the x-ray device. Upstream of the inlet to the pressure drop device, a pressure tap is situated so as to be in fluid communication with the coolant flow. In one embodiment, the pressure tap is connected to the conduit joining the external cooling unit with the pressure drop device. A pressure switch is attached to the pressure tap so as be in simultaneous contact with the coolant in the conduit and with the coolant in the reservoir.

In operation, the external cooling unit generates a flow of coolant that is directed through the fluid conduit connecting the external cooling unit with the pressure drop device. As the fluid passes through the conduit, it also fills the pressure tap and comes into operative communication with the pressure switch attached to the pressure tap. In this way, the pressure switch is able to sense the pressure of the coolant in the conduit. Further, because the pressure switch is in communication with coolant contained in the reservoir, the pressure switch is also able to sense coolant pressure in the reservoir, and thus, the pressure differential.

Preferably, the pressure drop between the fluid conduit connecting the external cooling unit to the pressure drop device, and the reservoir, is facilitated by the pressure drop device. In particular, as the coolant from the external cooling unit passes through the pressure drop device and into the reservoir, the pressure drop device, by virtue of its physical configuration, induces a drop in pressure in the coolant passing therethrough.

Since the pressure switch is immersed in the coolant in the reservoir, the pressure switch has a relatively constant natural reference pressure with which to determine the aforementioned pressure differential. As a result of such arrangement, the pressure switch generally is not exposed to fluctuating pressure differentials which could compromise the accuracy of the results obtained by the pressure switch. Further, because the pressure switch is located on a pressure tap off the coolant supply line to the pressure drop device, and is not "in-line," the pressure switch is able to sense the pressure differential in the cooling system without compromising the performance of the coolant system.

If the pressure differential sensed by the pressure switch is of a magnitude equal to or greater than the set point of the pressure switch, a circuit is completed, indicating that the rate of coolant flow has reached at least the minimum acceptable level. Preferably, the pressure switch is configured to close the circuit, thus indicating sufficient coolant flow, on rising pressure, and is configured to open the circuit, indicating insufficient coolant flow, on falling pressure.

In one embodiment, the pressure switch communicates with a controller, or the like, which is in communication with the x-ray device, so that in the event the differential pressure falls below an accepted range or value, the pressure switch can be used, at least indirectly, to shut down the x-ray device so as to prevent damage to the x-ray device from overheating as a result of inadequate coolant flow. Preferably, the pressure switch is also in electrical communication with a visual indicator, or the like, so that adequate coolant flow can be visually confirmed by the operator.

After exiting the pressure drop device, the coolant then enters the reservoir. In one embodiment, coolant entering the reservoir from the pressure drop device comes into contact with various structures of the x-ray device so as to absorb additional heat from the x-ray device. Ultimately, the coolant passing into the reservoir exits the reservoir by way of the exit connection and returns to the external cooling unit to repeat the cycle.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF VARIOUS EMBODIMENTS OF THE INVENTION

Reference will now be made to FIGS. wherein like structures will be provided with like reference designations. It is to be understood that the drawings are diagrammatic and schematic representations of various embodiments of the claimed invention, and are not to be construed as limiting the present claimed invention, nor are the drawings necessarily drawn to scale.

Figure 1:
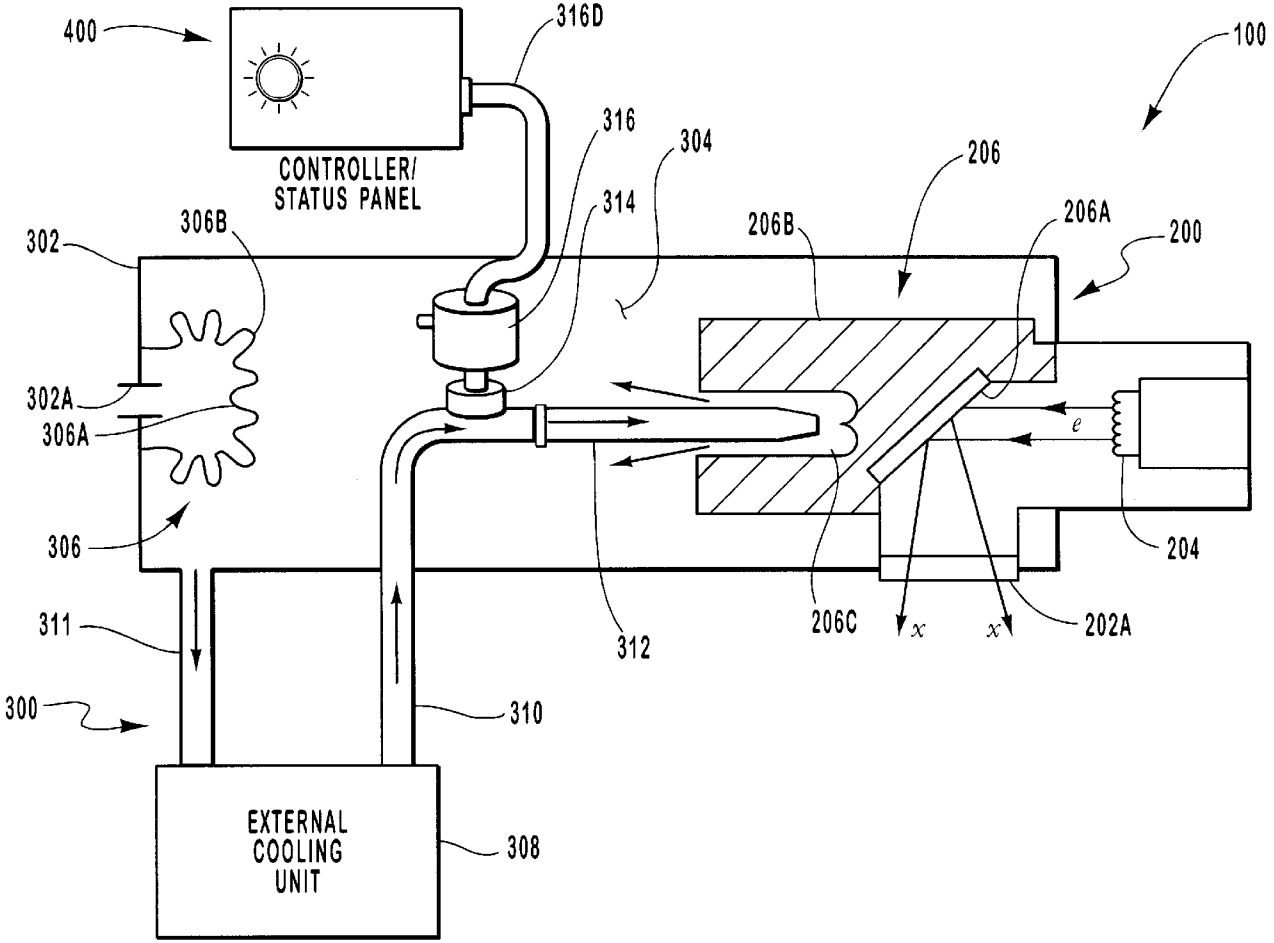
FIG. 1 is a partial cutaway of an embodiment of the cooling system in the context of a rotating anode type x-ray device.

Directing attention now to FIG. 1, an embodiment of an x-ray device is indicated generally at 100. As discussed in greater detail below, this embodiment of x-ray device 100 includes an x-ray tube 200 employing a stationary anode. One example of such an x-ray tube is an analytical x-ray tube ("AXT"). AXTs are useful in a variety of applications including, but not limited to, material composition analysis, fracture detection and evaluation, industrial material content control, and similar processes. Notwithstanding the foregoing example however, it will be appreciated that x-ray device 100 may employ a variety of other types of x-ray tubes as well. X-ray device 100 additionally includes a cooling system, indicated generally at 300. In general, cooling system 300 serves to remove heat from x-ray tube 200 of x-ray device 100.

X-ray rube 200 includes a vacuum enclosure 202 having a window 202A, preferably comprising beryllium or the like, through which x-rays are collimated for penetration into an object, such as a material sample. Disposed inside vacuum enclosure 202 are an electron source 204, preferably comprising a cathode, and stationary anode 206 having a target surface 206A positioned to receive electrons emitted by electron source 204. Target surface 206A preferably comprises a high "Z" number material such as tungsten (W) or the like.

In addition to target surface 206A, stationary anode 206 includes a body 206B which defines a coolant flow passage 206C. In a preferred embodiment, body 206B is substantially comprised of copper. However, it will be appreciated that body 206B may be comprised of various other materials such as copper alloys and the like. Furthermore, with respect to fluid passageway 206C, it will be appreciated that variables including, but not limited to, the size, geometry, and orientation of fluid passageway 206B may be varied either alone or in various combinations to facilitate achievement of one or more desired results with respect to the operation of x-ray tube 200 and/or cooling system 300.

In operation, an electrical current applied to electron source 204 causes electrons to be emitted by the process of thermionic emission. A high potential difference between electron 204 and stationary anode 206 causes electrons "e" to accelerate rapidly and travel towards target surface 206A at high velocity. Upon striking target surface 206A, electrons cause x-rays, denoted "x," to be produces. The x-rays "x" thus produced are then collimated through window 202A of vacuum enclosure 202. Heat generated as a result of electrons "e" striking target surface 206A of stationary anode 206 is at least partially dissipated through body 206B of stationary anode 206. As discussed in further detail below, at least some of the heat dissipated by body 206B of stationary anode 206 is removed from x-ray device 100 by cooling system 300.

Directing continuing attention to FIG. 1, various details regarding cooling system 300 are indicated. In particular, cooling system 300 of x-ray device 100 includes a reservoir 302 in fluid communication with fluid passageway 206B of stationary anode 206 and containing a volume of coolant 304 in which at least a portion of x-ray device 100 is disposed. Preferably, coolant 304 comprises a dielectric fluid such as Dow Syltherm 800, Dow Syltherm HF, Shell Diala AX, or the like. However, it will be appreciated that various other coolants may be employed as required to suit a particular application and/or to facilitate achievement of one or more desired results.

In the illustrated embodiment, reservoir 302 defines an air escape 302A that is in communication with the atmosphere. A bladder 306 is disposed about one side of air escape 302A such that an interior surface 306A of bladder 306 is exposed to the atmosphere by way of air escape 302A, and an exterior surface 306B of bladder 306 is in contact with coolant 304 disposed in reservoir 302. Bladder 306 is hermetically joined to reservoir 302 so as to substantially prevent contamination of coolant 304 by atmospheric air and to substantially prevent leakage of coolant 304 from reservoir 302 by way of air escape 302A. Finally, bladder 306 substantially comprises a flexible material compatible with coolant 304 and resistant to damage by heat. As discussed in greater detail below, the flexible nature of bladder 306 permits the volume of atmospheric air defined by bladder 306 to vary in accordance with the volume of coolant 304 in reservoir 302.

Cooling system 300 additionally includes an external cooling unit 308 which directs a flow of coolant through outlet conduit 310 to pressure drop device 312, and ultimately into reservoir 302. In general, external cooling units are well known in the art and typically include such elements as a coolant pump, heat exchanger(s), a secondary coolant such as a refrigerant, and associated piping and instrumentation. As discussed in further detail below, pressure drop device 312 is preferably arranged so that coolant 304 exiting pressure drop device 312 initially enters fluid passageway 206C of stationary anode 206. Finally, coolant 304 returns from reservoir 302 to external cooling unit 308 by way of inlet conduit 311.

It will be appreciated that a wide variety of piping, tubing, and the like may be employed to provide the functionality of outlet conduit 310 and inlet conduit 311. By way of example, outlet conduit 310 and inlet conduit 311 may comprise rubber tubing, metal piping, or the like. In general, any material, or combination thereof, compatible with coolant 304 and suitable for use as described herein is contemplated as being within the scope of the present invention.

With continuing reference to FIG. 1, a pressure tap 314 is disposed upstream of pressure drop device 312 and is arranged so as to be fluid communication with coolant passing through outlet conduit 310. Directing attention now to FIG. 2, and with continuing attention to FIG. 1, pressure tap 314 defines a fluid passageway 314A that communicates with outlet conduit 310. It will be appreciated that pressure tap 314 may be embodied in a variety of ways. For example, pressure tap 314 may be integral with outlet conduit 310, or may be alternatively be joined thereto, and, in either case, may comprise any of a variety of materials. Further, pressure tap 314 may include various types of connections or devices, including but not limited to, male or female threads, for engagement of pressure switch 316 (discussed below).

As indicated in the illustrated embodiment, pressure tap 314 is not "in-line," but rather is connected off the side of outlet conduit 310 so that coolant 304 circulating through coolant system 300 is not required to pass through pressure tap 314. Rather, a negligible amount of coolant 304 fills fluid passageway 314A, so that the pressure of coolant 304 is transmitted into fluid passageway 314A, but the bulk of coolant 304 simply bypasses pressure tap 314. As a consequence of its positioning, pressure tap 314 has no material effect with respect to the pressure of coolant 304 passing through outlet conduit 310. Further, it will be appreciated that because pressure tap 314 is not located in-line, the need for filters or related components is obviated.

Figure 2:
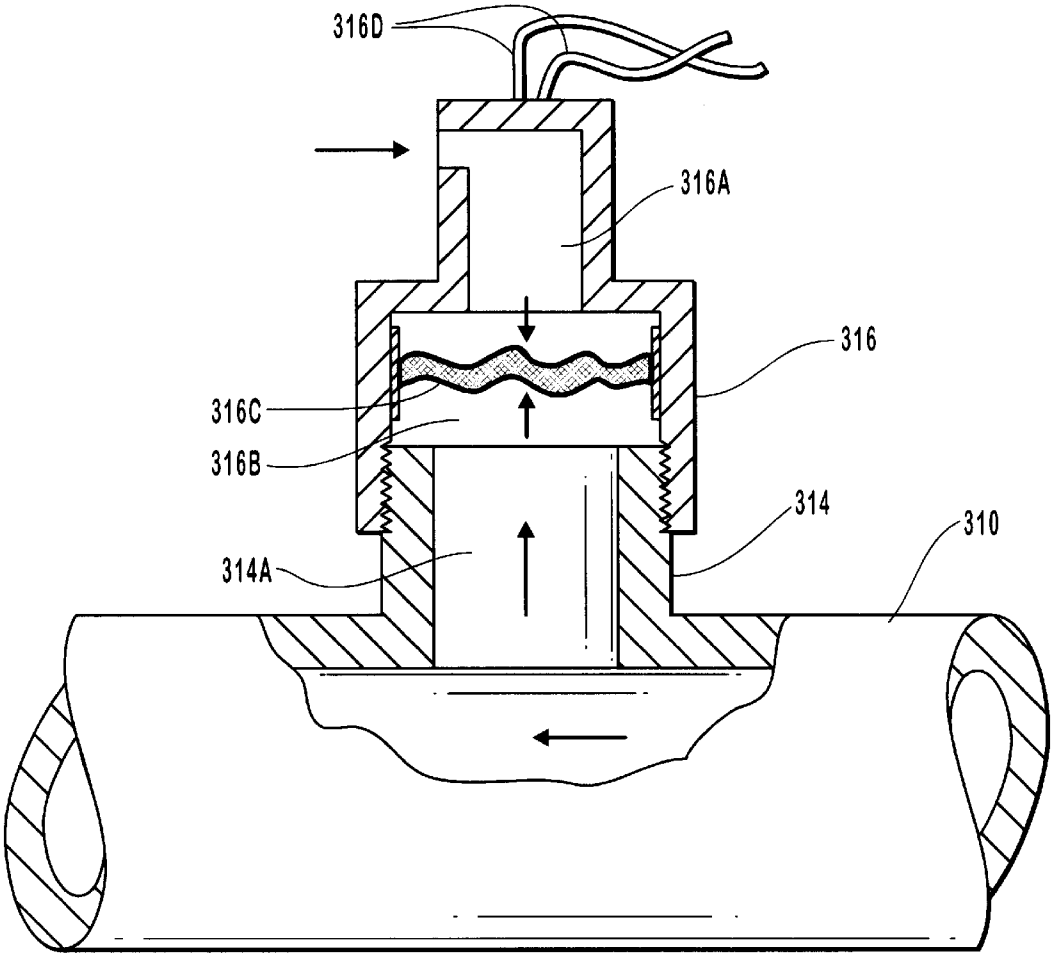
FIG. 2 is a cutaway view of an embodiment of the pressure switch.

With continuing reference to FIGS. 1 and 2, a pressure switch 316 is connected to pressure tap 314 in such a way that pressure switch 316 is in operable communication with coolant 304 disposed in pressure tap 314. In particular, one embodiment of pressure switch 316 defines an open-ended fluid passageway 316A that is separated from fluid passageway 316B, also defined by pressure switch 316, by way of a diaphragm 316C. Preferably, diaphragm 316C comprises Viton™ or the like. However, other diaphragm materials compatible with coolant 304 may be substituted. In general, those portions of pressure switch 316 in contact with coolant 304 should be comprised of materials compatible with coolant 304.

Directing continuing attention to various details of pressure switch 316, FIG. 2 indicates that fluid passageway 316B is in fluid communication with fluid passageway 314A of pressure tap 314. At least the open end of fluid passageway 316A is immersed in coolant 304 disposed in reservoir 302, or otherwise positioned or located so as to sense the pressure of coolant 302, so that diaphragm 316C of pressure switch 316 is simultaneously exposed to coolant passing through outlet conduit 310 as well as to coolant disposed in reservoir 302. As the operational details of pressure switches having the functionality of pressure switch 316 are well known, only a brief discussion thereof is provided.

In particular, pressure switch 316 is calibrated such that a given deflection of diaphragm 316C corresponds to a particular pressure differential. Thus, when diaphragm 316C is deflected by the difference in the pressure between coolant 304 in reservoir 302 and coolant 304 in outlet conduit 310, electrical circuitry (discussed below) in pressure switch 316 is able to correspond the deflection to a pressure differential.

When arranged as described above, pressure switch 316 is thus able to sense and quantify a differential between the pressure of coolant 304 in outlet conduit 310, and the pressure of coolant 304 in reservoir 302. It will be appreciated that where the value of this pressure differential is known, the corresponding coolant flow rate can be readily derived.

Another advantage of the arrangement of pressure switch 316 concerns the relative stability of the pressure of coolant 304 in reservoir 302 that is facilitated by bladder 306. In particular, since pressure switch 316 senses the pressure of coolant 304 in reservoir 302, the pressure switch has a relatively constant natural reference pressure with which to determine the aforementioned pressure differential. As a result of this arrangement, pressure switch 316 generally is not exposed to significant fluctuations in pressure differentials that could compromise the accuracy of the results obtained by, or by way of, pressure switch 316.

Note that while the embodiment illustrated in FIG. 1 indicates that pressure switch 316 is disposed in coolant 304 contained in reservoir 302, it will be appreciated that pressure switch 316 may, alternatively, be located outside reservoir 302 without materially impairing its functionality. In particular, in one alternative embodiment, fluid passageway 316A is connected to reservoir 302 by way of piping, tubing, or the like so that while pressure switch 316 is not immersed in coolant 304 in reservoir 302, diaphragm 316C is nevertheless exposed to the pressure of the coolant disposed in the reservoir.

Note that the foregoing arrangements are provided solely by way of example. In general, any arrangement wherein pressure switch 316 is able to sense the pressure of coolant in reservoir 302, as well as the pressure of coolant upstream of pressure drop device 312, is contemplated as being within the scope of the present invention.

It will be appreciated that the various aforementioned arrangements of pressure switch 316 represent an improvement over prior art systems wherein pressure switches are utilized to sense coolant pressure at only one point in the cooling system. As noted earlier, the single point monitoring arrangements of such prior art systems are inherently unable to provide verification of coolant flow.

Further, the use of pressure switch 316 in the manner described herein also obviates the need for expensive and bulky DP switches and thus, for at least the reasons discussed elsewhere herein, contributes to an overall reduction in the cost and maintenance of the cooling system. Additionally, because pressure switch 316 has only single fluid connection, i.e., where it is connected to coolant pressure tap 314, the likelihood of leakage from coolant system 300 is materially reduced. Finally, in the event pressure switch 316 and pressure tap 314 are immersed in coolant 304 in reservoir 302, a minor leak from either pressure switch 316 or pressure tap 314 would not impair in any way the functionality of cooling system 300 because the leaking coolant would simply leak into reservoir 302.

Turning now to the various electrical and control features and aspects of pressure switch 316, FIGS. 1 and 2 indicate that pressure switch 316 includes electrical leads 316D, insulated with a coolant-compatible material such as Teflon™ or the like, arranged to facilitate communication between an electrical circuit (not shown) in pressure switch 316 and controller/status panel 400, and/or other desired component(s). Various details regarding the electrical circuit are discussed below.

In general, pressure switch 316 incorporates a single-pole, single-throw, normally open ("NO"), circuit and is arranged so that the circuit is completed when the differential pressure sensed by pressure switch 316 reaches the set point or reaches a value within a range of acceptable values. Preferably, the circuit is completed on rising differential pressure. The circuit remains closed until the differential pressure drops to a level that corresponds to less than the minimum acceptable flow rate. Preferably, the circuit is opened on falling differential pressure.

It will be appreciated that various features of the electrical circuit of pressure switch 316 including, but not limited to, set point, sensitivity, normal circuit status (i.e., open or closed), or the like may be varied alone or in various combinations to suit a particular application and/or to facilitate achievement of one or more desired results. It will further be appreciated that FIG. 2 simply indicates one possible embodiment of pressure switch 316 and that pressure switch 316 and its constituent parts and features may be configured in any of a variety of different ways so as to provide the functionality disclosed herein.

With the foregoing discussion of various structure and features of cooling system 300 in view, attention is directed now to aspects of the operation of cooling system 300.

In operation, external cooling unit 308 generates a flow of coolant 304 that is directed through outlet conduit 310. As noted earlier, pressure tap 314 is in fluid communication with outlet conduit 310, and thus the pressure exerted by coolant 304 is transmitted through pressure tap 314 to diaphragm 316C of pressure switch 316 and acts on diaphragm 316C as described above. In this way, pressure switch 316 is exposed to the coolant pressure in outlet conduit 310.

After passing through outlet conduit 310, coolant enters pressure drop device 312. Pressure drop device 312 preferably comprises a nozzle or the like which functions both to induce a pressure drop in the coolant passing therethrough as well as to accelerate the coolant into fluid passageway 206C. It will be appreciated that the nozzle is simply one structure capable of performing the aforementioned functions. Accordingly, any other structure, or combination thereof, having functionality of a nozzle, as disclosed herein, is contemplated as being within the scope of the present invention.

As the accelerating coolant exits pressure drop device 312, it impinges upon the interior surfaces of fluid passage 206B, thereby absorbing at least some of the heat present in stationary anode 206. It will appreciated that the heat transfer thus effectuated can be further augmented through the use of various surface area augmentation structures disposed in passage 206B in such a way as to transfer heat from body 206B to coolant exiting pressure drop device 312. Various embodiments of such a surface area surface area augmentation structure are disclosed and claimed in U.S. patent application, Ser. No. 09/656,931, filed Sep. 6, 2000, entitled Cooling System for Stationary Anode X-ray Tubes, and incorporated herein in its entirety by this reference.

After coolant has exited pressure drop device 312 and absorbed heat from stationary anode 206, the coolant then exits fluid passageway 206C and flows into reservoir 302. Any increases in the volume of coolant 304 disposed in reservoir 302 are accommodated by bladder 306. In particular, as coolant 304 in reservoir 302 expands in response to being heated by x-ray tube 200, coolant 304 exerts pressure on exterior surface 306B of bladder 306, causing bladder 306 to deform in such a way as to accommodate the expansion of coolant 304. However, because interior surface 306A of bladder 306 is exposed to atmospheric pressure by way of air escape 302A, bladder 306 serves to insure that, regardless of the volume of coolant 304 disposed in reservoir 302, coolant 304 is always maintained substantially at atmospheric pressure.

As suggested earlier, open-ended fluid passageway 316A of pressure switch 316 allows pressure switch 316 to sense the pressure of coolant 304 in reservoir 302. Thus arranged, pressure switch 316 is able to sense the pressure drop in the coolant, imposed as a result of the coolant having passed through pressure drop device 312, because pressure switch 316 is positioned to sense both the pressure of coolant upstream from pressure drop device 312, as well as the pressure of coolant disposed in reservoir 302.

As previously noted, the pressure differential sensed by pressure switch 316 can readily be used to derive the corresponding coolant flow rate. For example, a graph of flow rate versus pressure drop can be empirically generated by varying the rate of flow through pressure drop device 312 on a test stand or the like, then noting the pressure drop that corresponds with a particular flow rate, and then plotting the flow rate—pressure drop curve characteristic of pressure drop device 312. It will be appreciated that various features of the geometry of pressure drop device 312 may be varied or configured so as to facilitate achievement of a desired pressure drop and flow rate.

When the differential pressure sensed by pressure switch 316 rises to a point corresponding to the minimum acceptable flow rate, a circuit is completed and controller/status panel 400 indicates that at least the minimum acceptable flow rate has been achieved. Conversely, if the differential pressure sensed by pressure switch 316 indicates that the coolant flow rate has fallen below the minimally acceptable level, the circuit in switch 316 will be opened, and controller status/panel will indicate that the coolant flow rate is inadequate. As discussed in further detail below, such a coolant fault can be used to shut down x-ray device 100.

It will be appreciated that additional circuitry and components could be employed to implement a cooling system wherein, rather than being used simply to indicate whether minimum coolant flow has been achieved or not, input from pressure switch 316 could be used to facilitate a continuous, real-time read-out or indication of the actual coolant flow rate.

Figure 3:
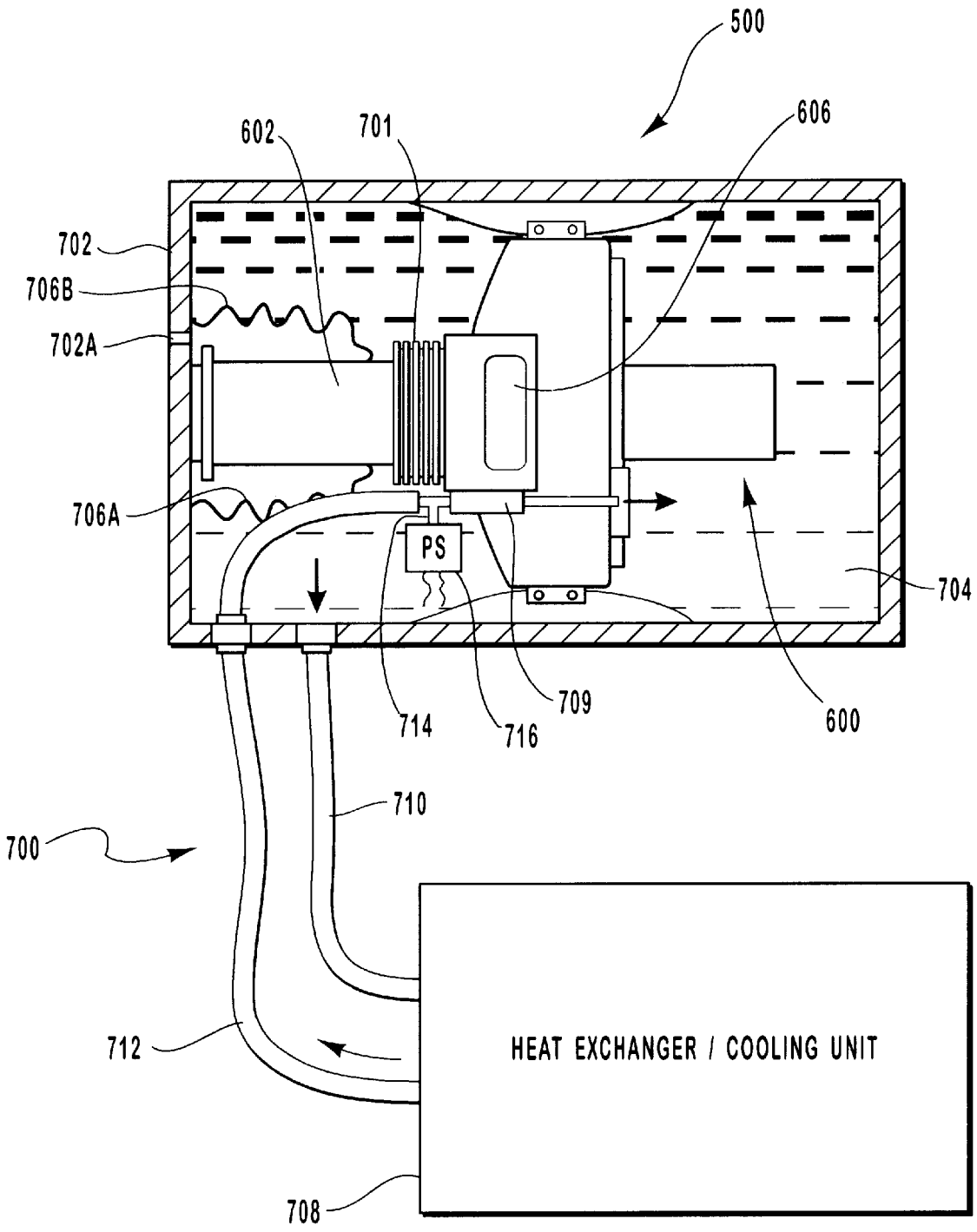
FIG. 3 is a partial cutaway of an embodiment of the cooling system in the context of a stationary anode type x-ray device.

Directing attention now to FIG. 3, various details of another embodiment of the present invention are indicated. In particular, a rotating type anode x-ray device is indicated generally at 500. It will be appreciated that rotating anode x-ray tubes may be employed in a wide variety of fields, including but not limited to, medical diagnostics and imaging. Accordingly, the present invention should not be construed to be limited to a particular rotating anode x-ray tube or to a particular application.

X-ray device 500 includes an x-ray tube 600 and cooling system 700. In general, x-ray tube 600 includes an electron source (not shown), preferably a cathode, and a rotating anode (not shown), preferably comprising copper or a copper alloy, disposed inside vacuum enclosure 602 on opposite sides of pressure drop device 701.

It will be appreciated that the functionality provided by pressure drop device 604 may be implemented in a variety of forms. One such form is a shield structure which, in general, defines one or more fluid passageways through which coolant is circulated so as to remove heat from the x-ray device. The fluid passageways of the shield structure serve to induce a pressure drop in the coolant as it passes therethrough. Various embodiments of such a shield structure are disclosed and claimed in U.S. patent application, Ser. No. 09/656,076, filed Sep. 6, 2000, entitled Large Surface Area X-ray Tube Shield Structure (the "'076 Application), and incorporated herein in its entirety by this reference.

In a well-known fashion, the electron source emits electrons, by thermionic emission, which pass through an opening defined by pressure drop device 701 (discussed in detail below) and are then received by a target surface of the rotating anode, wherein the target surface preferably comprises a high "Z" number material such as tungsten or the like. Upon impacting the target surface, the electrons produce x-rays which are collimated through window 606 and into, for example, the body of a patient. As discussed in detail below, cooling system 700 serves to remove at least some of the heat resulting from the impact of the electrons on the target surface of the rotating anode.

Directing continuing attention now to FIG. 3, cooling system 700 includes a reservoir 702 holding a volume of coolant 704 in which at least a portion of x-ray tube 600 is immersed. Cooling system 700 further includes a bladder 706 in communication with air escape 702A of reservoir 702, and having an interior surface 706A and exterior surface 706B. Bladder 706 functions in the manner generally described elsewhere herein to insure that coolant 704 disposed in reservoir 702 remains at substantially atmospheric pressure. External cooling unit 708 is connected to coolant manifold 709 and reservoir 702 by way of outlet conduit 710 and inlet conduit 712, respectively. Coolant manifold 709 in turn, is in fluid communication with pressure drop device 701.

Cooling system 700 further includes a pressure tap 714 in fluid communication with coolant upstream of pressure drop device 701. It will be appreciated that pressure tap 714 may be placed in a variety of locations. For example, pressure tap 714 may be connected to outlet conduit 710, incorporated as a part of coolant manifold 709, or as discussed previously, may be located outside of reservoir 702. A pressure switch 716 is attached to pressure tap 714 so that operational elements of pressure switch 716 are exposed to the pressure of the coolant upstream of pressure drop device 701. In general, pressure tap 714 and pressure switch 716 may be placed at any location that would permit pressure switch 716 to sense the pressure of coolant upstream of pressure drop device 701 and the pressure of coolant 704 in reservoir 702.

Note that, in general, the elements, operational features, characteristics, and advantages of pressure tap 714 and pressure switch 716, as well as their arrangement and disposition within the context of cooling system 700, are substantially the same as those of pressure tap 314 and pressure switch 316, discussed above in the context of another embodiment of the present invention. Accordingly, the following discussion will focus only on selected differences between the respective embodiments disclosed herein.

In operation, the flow of coolant generated by external cooling unit 708 passes through outlet conduit 710 and enters coolant manifold 709. As noted above, pressure tap 714 permits the operational elements of pressure switch 716 to be exposed to the coolant prior to the coolant entering pressure drop device 701. Upon entering coolant manifold 709, the coolant then passes through one or more fluid passageways defined by pressure drop device 701, thereby absorbing at least some heat produced by x-ray tube 600. The coolant then exits pressure drop device 701 and passes back into coolant manifold 709, whereupon the coolant is returned to reservoir 702.

As a result of having passed through the fluid passageways defined by pressure drop device 701, the coolant has realized a drop in pressure. As discussed above, the coolant in reservoir 702 is maintained at substantially atmospheric pressure and, because coolant 704 in reservoir 702 is in operative communication with pressure switch 716, pressure switch 716 is able to discern the difference in pressure between coolant upstream of pressure drop device 701 and coolant in reservoir 702.

In the manner described elsewhere herein, the pressure differential discerned by pressure switch 716 can then be used to determine whether or not the flow rate of coolant 704 is at a level that is consistent with safe and reliable operation of x-ray tube 600. As described in further detail below, the functionality of the pressure switch and the various embodiments of the x-ray tube cooling system disclosed herein can be usefully employed in the context of a coolant fault detecting system.

Figure 4:
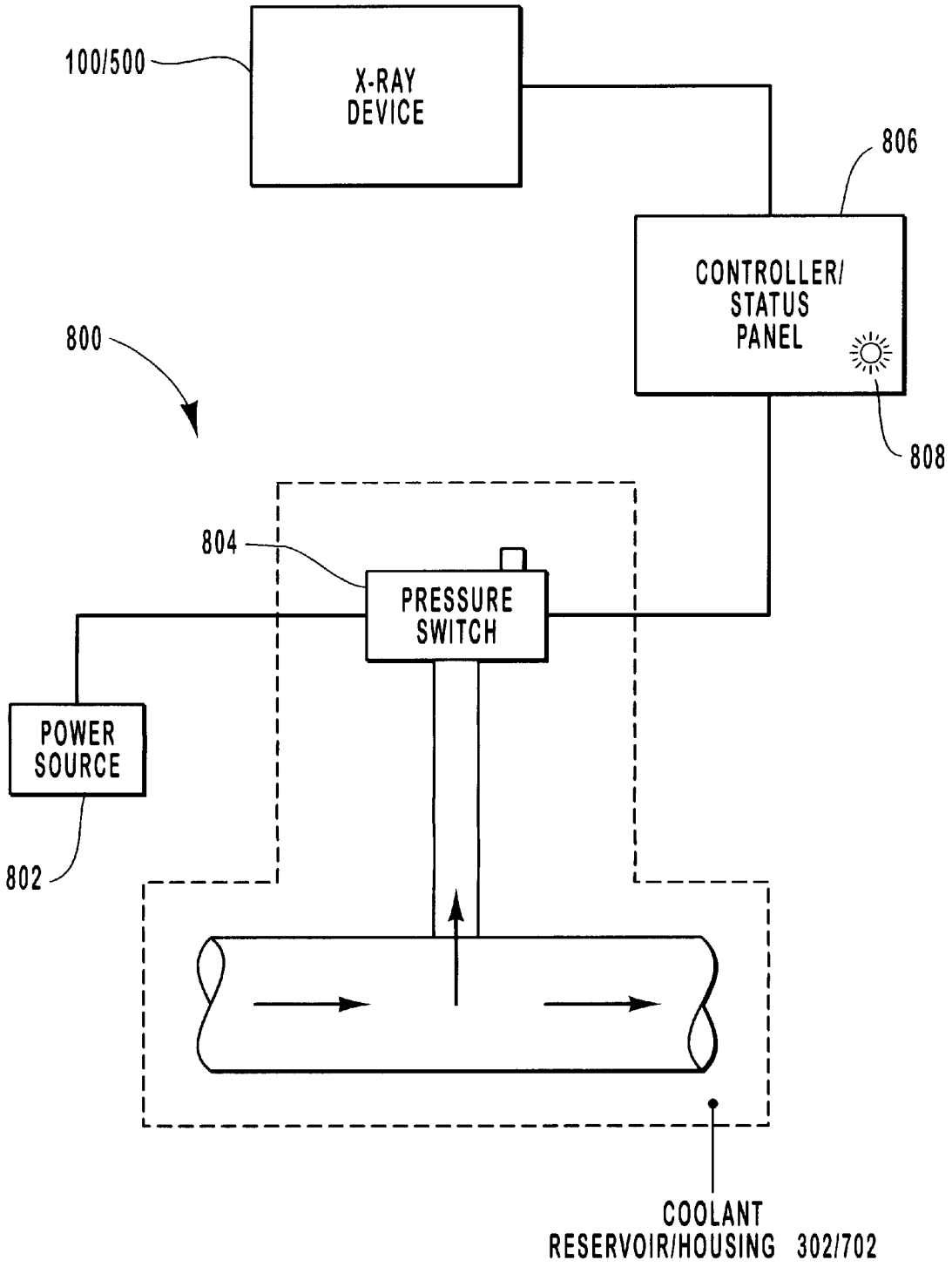
FIG. 4 is a block diagram of an embodiment of an x-ray device control system in accordance with the teachings of the present invention.

Directing attention now to FIG. 4, one embodiment of a coolant fault detecting system is indicated generally at 800. Coolant fault detecting system 800 includes a power source 802, pressure switch 804 and controller/status panel 806 in communication with x-ray device 100 (500) and having one or more indicators, displays, and readouts, collectively designated at 808. Such indicators, displays and readouts include, but are not limited to, visual indicators such as lights, audible alarms, digital readouts and displays, analog readouts and displays, and the like.

Consistent with various embodiments described elsewhere herein, pressure switch 804 is configured and arranged in such a manner that it is able to simultaneously sense the pressure of coolant upstream of a pressure drop device as well as the pressure of the coolant disposed in the reservoir of the x-ray tube cooling system. Power source 802 is operably connected with pressure switch 804 so as to provide power for the operation of pressure switch 804. Pressure switch 804 in turn, is in operable communication with controller/status panel 806.

In operation, pressure switch 804 senses a pressure differential between coolant in the reservoir and coolant upstream of the pressure drop device. In the event that the sensed pressure differential equals or exceeds the pressure differential corresponding to the minimum accepted flow rate of the coolant, power source 802 will cause pressure switch 804 to complete a circuit so that controller/status panel 806 indicates that the minimum acceptable flow rate has been achieved.

Achievement of the minimum accepted flow rate may be indicated in a variety of ways including, but not limited to, a visual indication such as that provided by indicators, displays, and readouts 808. Preferably, pressure switch 804 is configured so that the circuit is completed on rising differential pressure. Should the pressure differential sensed by pressure switch 804 fall below the value corresponding to the minimum accepted flow rate, the circuit in pressure switch 804 will be opened and indicators, displays, and readouts 808 on controller/status panel 806 will indicate that coolant flow rate has fallen below the minimal acceptable level. In one embodiment, controller/status panel 806 is at least indirectly interlocked with x-ray device 100 (500) so that in the event the coolant flow rate falls below the minimum accepted level, x-ray device 100 (500) will be automatically shut down.

It will be appreciated that the pressure differential sensed by pressure switch 804 may be used to facilitate the gathering and/or display of a variety of data or information concerning the flow of coolant. For example, the pressure differential may be used simply to energize a visual indicator 808, thereby indicating the coolant flow rate is acceptable. In this example, visual indicator 808 would be extinguished if the coolant flow rate became unacceptably low. The extinguished visual indicator 808 would provide notice to the operator that the coolant flow rate was too low. It will be appreciated that such an arrangement could be reversed so that visual indicator 808 was lit when the coolant flow rate was too low, and extinguished when the coolant flow rate was acceptable.

As another example, coolant fault control system 800 may additionally include warning indicators 808 to signal when the coolant flow rate is dropping. This capability would give the system operator advance notice that the x-ray device could shut down. As yet another example, the actual pressure differential sensed by pressure switch 804 may be indicated on display 808, and/or the actual flow rate, to which the pressure differential corresponds, may be shown in real time on display 808. Furthermore, pressure switch 804 need not be interlocked with the x-ray device. Instead, coolant fault control system 800 may be configured so as to simply sense, and indicate, display, or otherwise present, coolant flow data on a status panel.

Furthermore, it will be appreciated that various different types of instrumentation and functionalities may be implemented within the context of coolant fault detecting system 800. For example, various embodiments of coolant fault detecting system 800 may include pressure gauges, temperature gauges, thermostats, or the like. Additionally, the degree of control that coolant fault detecting system 800 exerts over the operation of x-ray device 500 may be adjusted or implemented in a variety of ways.

For example, coolant fault detecting system 800 may include such components as timers and the like so that in the event x-ray device 100 (500) is shut down as a result of an unacceptably low coolant flow rate, x-ray device 100 (500) would be prevented from being restarted until passage of a specified period of time. Alternately or additionally, coolant fault detecting system 800 may be configured so that x-ray device 100 (500) would attempt to restart itself after passage of a predefined period of time.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An x-ray device, comprising:

(a) an x-ray tube including an electron source and an anode, said anode having a target surface positioned to receive electrons emitted by said electron source; and (b) a cooling system, said cooling system directing a flow of coolant proximate to said x-ray tube so that said coolant removes at least some heat therefrom, said cooling system including:

(i) a reservoir containing a portion of said coolant;

(ii) a pressure drop device;

(iii) an external cooling unit, said external cooling unit circulating coolant through said reservoir and said pressure drop device; and (iv) a pressure switch in operative communication with coolant upstream of said pressure drop device and with coolant in said reservoir, said pressure switch facilitating determination of a coolant flow rate by sensing a pressure differential between coolant upstream of said pressure drop device and coolant in said reservoir.

2. The x-ray device as recited in claim 1, wherein said anode defines a fluid passageway in fluid communication with said reservoir so that at least some of said coolant passes through said fluid passageway and removes heat from said anode.

3. The x-ray device as recited in claim 1, wherein said pressure drop device comprises a shield structure interposed between said anode and said electron source, said shield structure passing said electrons from said electron source to said target surface of said anode.

4. The x-ray device as recited in claim 1, wherein at least a portion of said x-ray tube is immersed in said coolant disposed in said reservoir.

5. The x-ray device as recited in claim 1, wherein said anode is a rotating type.

6. The x-ray device as recited in claim 1, wherein said anode is a stationary type.

7. A cooling system for an x-ray tube, comprising:

(a) an external cooling unit circulating a flow of coolant proximate to the x-ray tube so that said coolant removes at least some heat from the x-ray tube;

(b) a reservoir in fluid communication with said external cooling unit so that said coolant is circulated through said reservoir;

(c) a pressure drop device in fluid communication with said external cooling unit, said pressure drop device inducing a decrease in pressure of said coolant as said coolant passes through said pressure drop device;

(d) a pressure switch in operative communication with coolant upstream of said pressure drop device and with coolant in said reservoir, said pressure switch facilitating determination of a coolant flow rate by sensing a pressure differential between coolant upstream of said pressure drop device and coolant in said reservoir; and (e) a status panel in communication with said pressure switch, said pressure switch causing said status panel to present coolant flow information corresponding to said pressure differential.

8. The cooling system as recited in claim 7, wherein said pressure drop device comprises a shield structure.

9. The cooling system as recited in claim 7, wherein said pressure drop device comprises a nozzle.

10. The cooling system as recited in claim 7, wherein said pressure switch is substantially immersed in coolant disposed in said reservoir.

11. The cooling system as recited in claim 7, wherein said pressure switch is located outside said reservoir.

12. The cooling system as recited in claim 7, wherein said coolant in said reservoir is maintained at substantially atmospheric pressure.

13. The cooling system as recited in claim 7, wherein said coolant flow information comprises coolant flow rate.

14. The cooling system as recited in claim 7, wherein said coolant comprises a dielectric liquid.

15. In a cooling system of an x-ray device, the cooling system including an external cooling unit circulating a flow of coolant through a pressure drop device and a reservoir, a coolant fault detecting system for facilitating control of the x-ray device, the coolant fault detecting system comprising:

(a) a power source;

(b) a pressure switch operably connected to said power source, said pressure switch being in operative communication with coolant upstream of the pressure drop device and with coolant in the reservoir, said pressure switch sensing a pressure differential between coolant upstream of the pressure drop device and coolant in the reservoir; and (c) a controller in operative communication with said pressure switch and the x-ray device so that when a magnitude of said pressure differential falls outside an acceptable range of values, said controller causes a response by the x-ray device that corresponds to said magnitude of said pressure differential sensed by said pressure switch.

16. The coolant fault detecting system as recited in claim 15, further comprising a status panel in communication with said pressure switch, said pressure switch causing said status panel to present coolant flow information corresponding to said pressure differential.

17. The coolant fault detecting system as recited in claim 15, wherein said response comprises shut down of the x-ray device.

18. In an x-ray device including a cooling system having an external cooling unit circulating a flow of coolant through a pressure drop device and a reservoir, and the cooling system also including a pressure switch in fluid communication with coolant in the reservoir and with coolant upstream of the pressure drop device, a method for facilitating control of the x-ray device, the method comprising the acts of:

(a) sensing, by way of the pressure switch, coolant pressure in the reservoir and coolant pressure upstream of the pressure drop device;

(b) determining, by way of the pressure switch, a pressure differential between said coolant pressure in the reservoir and said coolant pressure upstream of the pressure drop device;

(c) comparing said pressure differential determined by the pressure switch with at least one predefined range of pressure differentials; and (d) causing a characteristic response by the x-ray device when said pressure differential falls outside said at least one range of predefined pressure differentials.

19. The method according to claim 18, further comprising the act of presenting coolant flow data corresponding to said pressure differential sensed by the pressure switch.

* * * * *

UNITED STATES PATENT AND TRADEMARK OFFICE

CERTIFICATE OF CORRECTION

PATENT NO. : 6,366,642 B1
DATED : April 2, 2002
INVENTOR(S) : Gregory C. Andrews It is certified that error appears in the above-identified patent and that said Letters Patent is hereby corrected as shown below:

Column 4,
Line 16, delete “rates”

Column 5,
Line 20, change “in” to -- is --

Column 6,
Line 19, after “as” insert -- to --

Column 8,
Line 1, change “rube” to -- tube --
Line 29, after “electrons” insert -- e --

Column 9,
Line 22, before “fluid” insert -- in --
Line 29, after “may” delete -- the --

Column 11,
Line 65, delete second “surface area”

Signed and Sealed this

Eleventh Day of March, 2003

JAMES E. ROGAN
*Director of the United States Patent and Trademark Office*